US005563681A

United States Patent [19]

Kirkwold et al.

[11] Patent Number: 5,563,681

[45] Date of Patent: Oct. 8, 1996

[54] ARTICLE AND METHOD FOR COOLING A SHEET OF MATERIAL WHILE MINIMIZING WRINKLING AND CURLING WITHIN THE SHEET

[75] Inventors: John O. Kirkwold, Champlin; Roger H. Muntifering; Steven W. Sorensen, both of Maplewood; Thomas F. Gotich, Eagan; Robert M. Biegler, Woodbury, all of Minn.

[73] Assignee: Minnesota Mining and Manufacturing Company, St. Paul, Minn.

[21] Appl. No.: 540,290

[22] Filed: Oct. 6, 1995

Related U.S. Application Data

[63] Continuation-in-part of Ser. No. 336,498, Nov. 9, 1994, abandoned.

[51] Int. Cl.[6] ..... G03D 13/02

[52] U.S. Cl. ..... 355/30; 355/309; 432/59; 165/80.3

[58] Field of Search ..... 355/309, 30, 52; 165/185, 80.1, 80.3, 135, 133; 432/59–62; 219/216, 218

[56] References Cited

U.S. PATENT DOCUMENTS

| | | | |
|---|---|---|---|
| D. 321,804 | 11/1991 | Wolff et al. | D6/566 |
| 3,689,609 | 9/1972 | Robinson | 264/40 |
| 3,914,097 | 10/1975 | Wurl | 432/59 |
| 4,485,294 | 11/1984 | Rosenberg | 219/216 |
| 4,514,900 | 5/1985 | Benard | 29/727 |
| 4,545,671 | 10/1985 | Anderson | 355/3 SH |
| 5,201,866 | 4/1993 | Mok | 165/80.3 |
| 5,207,971 | 5/1993 | Volungis | 264/564 |
| 5,221,200 | 6/1993 | Roztocil et al. | 432/59 |

FOREIGN PATENT DOCUMENTS

| | | | |
|---|---|---|---|
| 58211152 | 12/1983 | Japan | G03D 13/00 |
| 1061752 | 3/1989 | Japan | G03D 13/00 |
| 3208048 | 9/1991 | Japan | G06L 5/00 |
| 05-331299 | 12/1993 | Japan | C08S 5/18 |
| 2037005A | 7/1980 | United Kingdom | G03D 13/00 |

*Primary Examiner*—Arthur T. Grimley
*Assistant Examiner*—Herbert V. Kerner
*Attorney, Agent, or Firm*—Gary L. Griswold; Walter N. Kirn; William K. Weimer

[57] ABSTRACT

A cooling article adapted for use with a thermal-processing apparatus for cooling a thermally-processable element after the element is heated by a heating member within the thermal-processing apparatus. The cooling article can include a cooling plate having a textured and/or perforated top surface positionable relative to the heated member so that the sheet slides on the top surface.

25 Claims, 4 Drawing Sheets

ARTICLE AND METHOD FOR COOLING A SHEET OF MATERIAL WHILE MINIMIZING WRINKLING AND CURLING WITHIN THE SHEET

REFERENCE TO RELATED APPLICATION

This application is a continuation-in-part of commonly assigned and U.S. Ser. No. 08/336,498 now abandoned filed Nov. 9, 1994, and entitled "Article and Method for Cooling a Sheet of Material While Minimizing Wrinkling and Curling Within the Sheet".

FIELD OF THE INVENTION

The present invention is directed generally to an apparatus and method for cooling heated sheets of material, and is directed more specifically to an apparatus and method for cooling sheets of material while minimizing the wrinkling within the sheets.

BACKGROUND OF THE INVENTION

Various medical, industrial, and graphic imaging applications require the production of very high quality images on sheets or lengths of photothermographic materials. Sheets, lengths, and rolls of photothermographic materials are referred to as photothermographic elements. An exposed photothermographic element is thermally processed, that is, heated by a heated member within a processing apparatus, to at least a threshold development temperature for a specific period of time to develop the image within the photothermographic element. Subsequently, the photothermographic element must be cooled by a cooling member or apparatus within the processing apparatus to allow a user to hold the element while examining the developed image. Photothermographic elements generally include an emulsion coated onto a paper base or backing, or polyester film base. The emulsion coating, when heated, becomes soft and vulnerable to surface abrasions or marring, and delamination from the base during the transporting of the photothermographic element across components within the processing apparatus. One known cause of these problems is the component within the processing apparatus which directs the sheet away from the heated member, such as a heated, rotating drum, and toward the cooling apparatus.

Like the emulsion coating, the polyester film base softens when heated. In addition, the polyester film is susceptible to dimensional changes during heating and/or cooling. Uncontrolled dimensional changes which occur during cooling can results in wrinkling, especially when the rate of cooling the photothermographic material is increased. Increasing the cooling rate within known processing apparatus can increase productivity and/or reduce the space needed for cooling. But, increasing the cooling rate also can increase wrinkling.

One known apparatus and method for cooling includes a plurality of rotating nip rollers which withdraw the heat from each sheet after the sheet is processed by the heating component. Because the sheet shrinks as it cools, the constraining of the sheet by the nip rollers can cause wrinkles in the sheet which significantly affect the image quality. As shown in FIG. 1, opposing, diagonal wrinkles 2 in the polyester-film base 4 of the sheet 6 are caused by this constraint and appear like sloping branches of an evergreen tree.

Rollers present other problems. First, rollers can be difficult to keep clean. The emulsion 8 from the sheet 6, when heated, can gradually transfer from the sheet and build-up on the rollers which are not easily cleaned. A build-up of emulsion 8 on the cooling surface can change the conductivity and cooling effectiveness of the rollers, and the build-up can retransfer to subsequent sheets. Furthermore, known cooling rollers are not inexpensive and can include several parts to function smoothly, which adds complexity to the installation, cleaning, and repair of the rollers.

In addition to wrinkling and emulsion transfer, a heated and cooled sheet can suffer from excessive curling. This can occur because the sheet is heated when on a curved surface such as a rotating drum. As shown in FIG. 1, a curl C in a sheet 6 of radiographic film (used for medical diagnoses) causes the sheet 6 to lift away from the lightbox 9. At the very least, this inconveniences the medical specialist who is attempting to examine the sheet 6. Like radiographic film sheets, image-setting sheets and other sheets can suffer from undesirable curling.

There is a need for a cooling apparatus or article and method which offers sufficient cooling productivity, cost-effectiveness, and ease of assembly and repair, but without causing an unacceptable amount of wrinkling and curling within the sheet base and scratches in the sheet base or emulsion. In conjunction with this cooling apparatus or article, there is a need for a component which properly directs the sheet from the heating member to the cooling apparatus or article, but without delaminating or stripping the soft emulsion away from the base.

SUMMARY OF THE INVENTION

The present invention overcomes these problems by providing a cooling article adapted for use with a thermal-processing apparatus for cooling a thermally-processable element after the element is heated by a heating member within the thermal-processing apparatus. The cooling article includes a cooling plate having a top surface. The top surface is positioned relative to the heated member so that the element is transported from the heating member and slides on at least a portion of the top surface. The top surface is textured so that not more than 80 percent of the portion of the top surface on which the sheet slides contacts the element.

The top surface can be stationary. The cooling plate can have a bottom surface coupled to which is at least a first fin. An epoxy layer can couple the first fin to the bottom surface of the cooling plate.

Another embodiment of the present invention includes an apparatus for thermally processing a thermally-processable element. The apparatus includes a housing. A heating member within the housing receives and heats the thermally processable element. A cooling article positioned in the housing and relative to the heating member receives the thermally processable element from the heating member and cools the thermally processable element. The cooling article includes a cooling plate having a top surface positioned relative to the heating member so that the sheet is transported from the heating member and slides on at least a portion of the top surface. The top surface is textured so that not more than 80 percent of the portion of the top surface on which sheet slides contacts the sheet.

Another embodiment of the present invention includes an apparatus for creating an visible image on a photothermographic element. The apparatus includes a housing having an input station. The input station can accept a container containing the photothermographic element. A transport component is positioned within the housing and relative to the input station for transporting the photothermographic element within the housing. An exposure station is positioned within the housing and relative to the transport component. The exposure station can receive the photothermographic element from the transport component and expose the photothermographic element to an image-wise pattern of light to create a first image on the photothermographic element. A thermal processing station is positioned within the housing and relative to the transport component and the exposure station. The thermal processing station includes a heating member which can receive the photothermographic element transported by the transport component from the exposure station and can heat the photothermographic element to a sufficient temperature for a sufficient duration to develop the first image to the visible image. A directing component is positioned relative to the heating member for directing the photothermographic element from the heating member. A cooling article for cooling the photothermographic element includes a top surface positioned relative to the directing component and the heating member so that the sheet slides on at least a portion of the top surface. The top surface is textured so that not more than 80 percent of the portion of the top surface on which the sheet slides contacts the sheet.

Another embodiment of the present invention includes a method of minimizing curling of an exposed thermally-processable element while cooling the element after the element is heated by a heating member within the thermal-processing apparatus while minimizing wrinkling within the sheet. The method includes the step of directing the element across a cooling plate having a top surface positioned relative to the heated member so that the element is transported from the heating member and slides over at least a portion of the top surface. The top surface is textured so that not more than 80 percent of the portion of top surface on which the element slides contacts the element.

Another embodiment of the present invention is a cooling article adapted for use with a thermal-processing apparatus for cooling a thermally-processable element after the element is heated by a heating member of the thermal-processing apparatus. The cooling article includes a cooling member having a cooling surface. The cooling surface is positioned relative to the heated member so that the element is transported from the heating member and slides on at least a portion of the cooling surface. The top surface is perforated.

Another embodiment of the present invention is a method for cooling a thermally-processable element after the element is heated by a heating member within a thermal-processing apparatus. The method includes directing the element across a cooling plate having a top surface positionable relative to the heated member so that the element is transported from the heating member and slides over at least a portion of the top surface. The top surface is perforated.

BRIEF DESCRIPTION OF THE DRAWINGS

The foregoing advantages, construction, and operation of the present invention will become more readily apparent from the following description and accompanying drawing in which.

DETAILED DESCRIPTION

Figure 2:
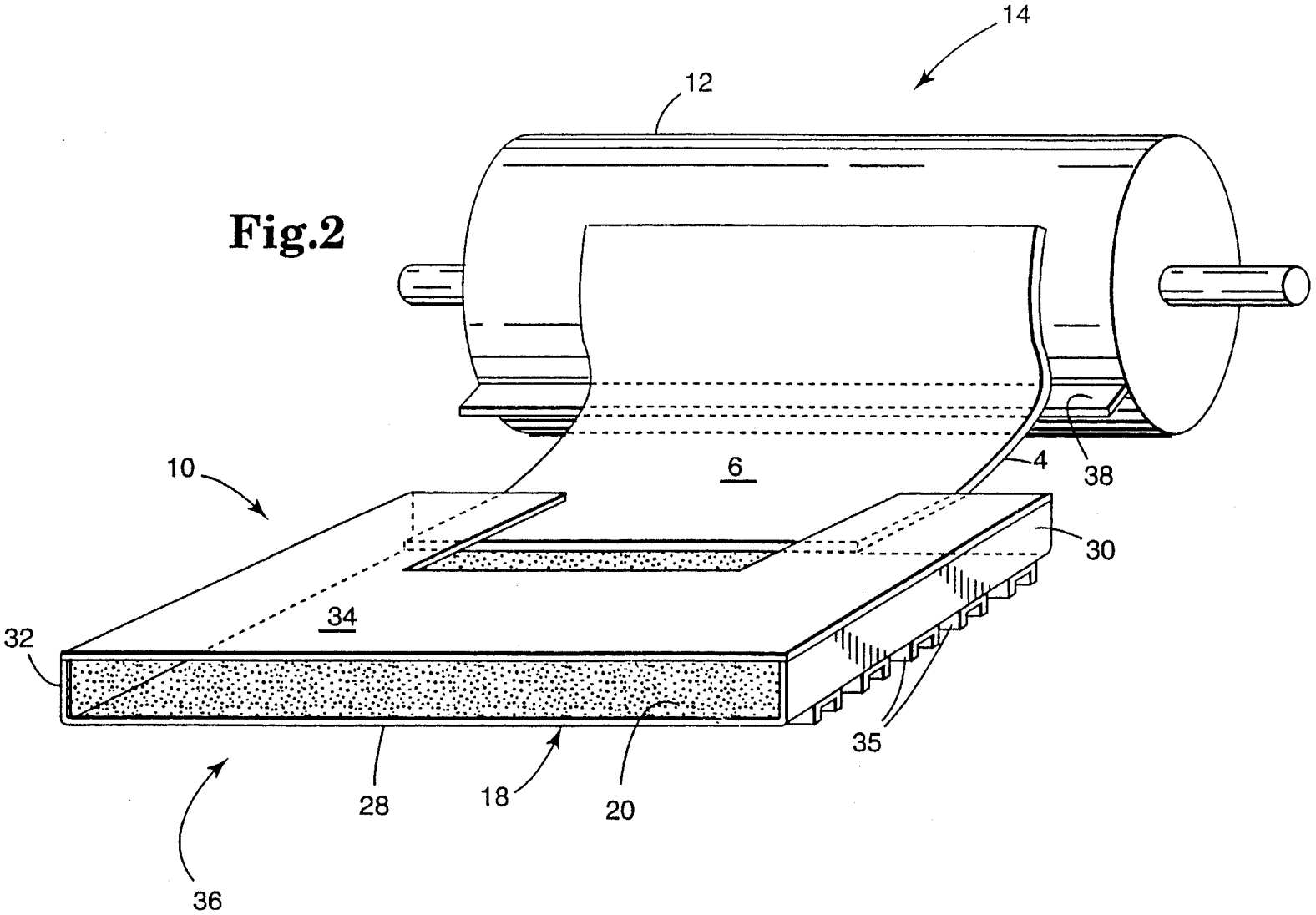
FIG. 2 is a perspective view of one embodiment of a cooling article positioned relative to a heated drum.

One embodiment of a cooling article 10 is shown in FIG. 2 as receiving an element or sheet 6 of thermally-processable material from a heated drum 12, a form of heating member within the thermal-processing apparatus 14. The sheet 6 can be made of a backing or base 4 coated with a thermally-processable emulsion 8. Examples of the base 4 include paper, polyester film, or the like. Examples of the emulsion 8 include silver halide-based, diazo, or the like. Elements of the thermally-processable material, other than the sheet 6, can also be cooled by the cooling article 10, including elements fed into the thermal-processing apparatus in roll-form.

The cooling article 10 includes a cooling plate 18 having a top surface 20 on which the sheet 6 slides. The cooling plate 18 can be flat and can be stationary. By stationary, it is generally meant that the cooling plate 18 does not move while the sheet 6 slides over the cooling plate 18, unlike cooling nip rollers.

The cooling plate 18 is made of a thermally conductive material such as aluminum, copper, steel, or the like. The cooling plate 18 withdraws heat from the sheet 6 to cool the sheet 6 to a sufficiently low temperature so that a user can pick up the sheet 6 to examine the thermally processed image.

Figure 1:
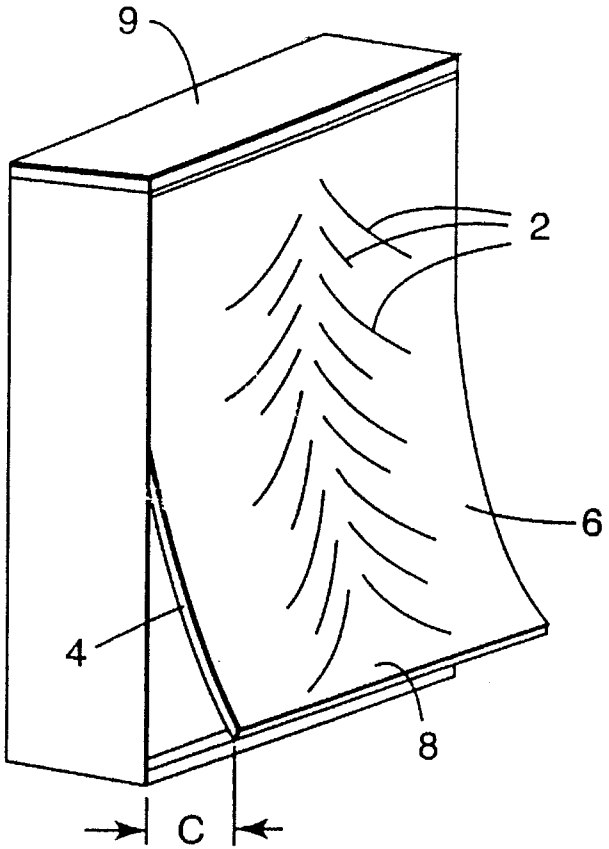
FIG. 1 is a perspective view of a film sheet attached to a lightbox.

The cooling plate 18 is shown as contacting the emulsion 8, although this is not necessary. Using the cooling plate 18, the sheet 6 is cooled while relatively flat and without being constrained or compressed by, for example, cooling nip rollers. This lack of constraint and pressure allows for consistent dimensional changes within the sheet 6 during cooling. As a result, wrinkling, like that shown in FIG. 1, is reduced.

To prevent the cooling plate 18 from scratching or marring the emulsion 8, the top surface 20 of the cooling plate 18 is relatively smooth. However, to control the cooling rate of the sheet 6, the top surface 20 is sufficiently textured. This term, textured, is meant to refer to a surface which is not smooth. The texture slows the cooling rate because the top surface 20, at any one instance, contacts only a portion of the sheet 6 sliding over the cooling plate 18 (i.e., less than 100 percent contact). As a result, the top surface 20 withdraws the heat from the sheet 6 at a slower rate than if the top surface 20 had not been textured. This slower cooling rate reduces the curling of the sheet 6 which can occur because the sheet 6 was heated while contacting the curved surface of the heated drum 12.

A texture which causes the top surface 20 to contact approximately 20–80 percent of the portion of the sheet 6 sliding over the cooling plate 18 compromises the reduction of marring of the emulsion 8 with the reduction of the curling of the sheet 6. A texture which causes the top surface to contact approximately 40–70 percent more finely compromises the reduction of marring and curling. A texture which causes the top surface to contact approximately 50–65 percent even more finely compromises the reduction of marring and curling.

The texture of the top surface 20 has other beneficial effects. For example, when the emulsion 8 is heated, gases can be formed and be released from the emulsion 8. When the emulsion 8 is contacting the top surface 20, the gases can escape from between the emulsion 8 and the top surface 20. This is referred to as outgassing. Without outgassing, trapped gases can adversely effect the emulsion surface and the image being developed within the emulsion 8.

To effectively guide the sheet 6 after the sheet 6 is on the cooling article 10, the cooling article 10 can include side walls 30, 32 and a top cover 34. The cooling plate 18, side walls 30, 32, and top cover 34 form a chute 36 through which the sheet 6 can pass. The chute 36 prevents the sheet 6 from sliding sideways off the cooling plate 18 and can direct the sheet 6 to an exit port (not shown).

In addition, the chute 36 can be made sufficiently open with a generally C-shaped top cover 34 so that sheets 6 which stick or jam within the chute 36 can be easily cleared by an operator. The openness also prevent the trapping of hot air which reduces convection within the chute and uneven cooling. Moreover, the openness and the absence of moving parts with the chute 36 allows for simpler cleaning of residual emulsion 8 from the chute 36, when compared to known cooling means such as cooling rollers.

The side walls 30, 32 and the top cover 34 can be made of the same material as the cooling plate 18. The side walls 30, 32 can be formed by bending the sides of the cooling plate 18 upwardly. This eliminates sharp edges on which the ends of the sheet 6 can be scratched. The top cover 34 can have the same textured surface and be welded to the side walls 30, 32, or joined with an epoxy so that the textured surface faces the top surface 20 of the cooling plate 18.

To increase the thermal mass of the cooling article 10 and allow for cooling of consecutive sheets 6, the cooling article 10 can include one or more cooling fins 35. The cooling fins 35 can be coupled to the cooling plate 18 rather than, for example, welding these components. Using epoxy to join the fins 35 to the bottom surface 28 does not create a risk of harming the top surface 20, unlike welding. Welding can result in the roughening of the top surface 20 to the point where a sheet 6 can be scratched when sliding over the top surface 20. In addition, the epoxy provides sufficient thermal conductivity allowing the cooling article 10 to cool a succession of heated sheets 6 with minimal wrinkling.

One example of the cooling article 10 to cool a photothermographic sheet is a stainless steel cooling plate 18, approximately 0.09 centimeter thick, 38.1 centimeters×16.5 centimeters. The side walls 30, 32 are approximately 2.1 centimeters in height. The top surface 20 has a Rigid-Tex texture or pattern #3-ND (Rigidized Metal Corp., 658 Ohio Street, Buffalo, N.Y. 14203-3185). This texture creates a top surface 20 which, at any one instance, contacts approximately 50–65 percent of the portion of the sheet 6 sliding over the cooling plate 18. Five cooling fins 35, as shown in FIG. 1, are attached to the bottom surface 28 of the cooling plate 18. The fins 35 shown in FIG. 2 are made of lengths of aluminum channel and are attached to the bottom surface 28 of the cooling plate using an epoxy (3M Company, St. Paul, Minn., Scotchweld-TM DP-420).

Using the above-described example of the cooling article 10, a sheet 6 is cooled from approximately 122 degrees Centigrade to approximately 60 degrees Centigrade, and at a rate of not less than one sheet 6 (above-described photothermographic sheet) every thirty seconds. In addition, when compared with a sheet cooled using cooling nip rollers, the sheet 6 has approximately 90 percent fewer wrinkles. Plus, when compared with a sheet cooled using a flat top surface 20, the curl C within the sheet 6, shown in FIG. 1, is reduced to approximately 0.16 centimeters. Furthermore, this is accomplished without causing an unacceptable amount of image-damaging scratches or marring. The photothermographic sheet used is disclosed in pending U.S. Pat. application Nos. 08/072,153 and 08/239,984, filed on Nov. 23, 1993 and May 9, 1994 respectively, both assigned to 3M Company, St. Paul, Minn., 55144. The size of this sheet is approximately 35.6 centimeter×43.2 centimeter.

For directing the sheet 6 from the heated drum 12 to the cooling article 10, the thermal processing apparatus 14 can also include a stripper 38. The stripper can be positioned relative to the heated drum 12 so that the sheet 6 is directed away from the heated drum 12 at an angle of 23 degrees from horizontal. To prevent the build-up of a static charges on the stripper 38, the stripper 38 can be made of a conductive material and electrically grounded or connected to another conductive member which can absorb or dissipate the static charges. Without the prevention of the static build-up, a sheet 6 can become attracted and stick to the stripper, particularly when the sheet 6 has a film base 4. The sticking of a sheet 6 to the stripper can cause scratching of the emulsion 8 and/or delamination of the emulsion 8 from the base 4.

Figure 3:
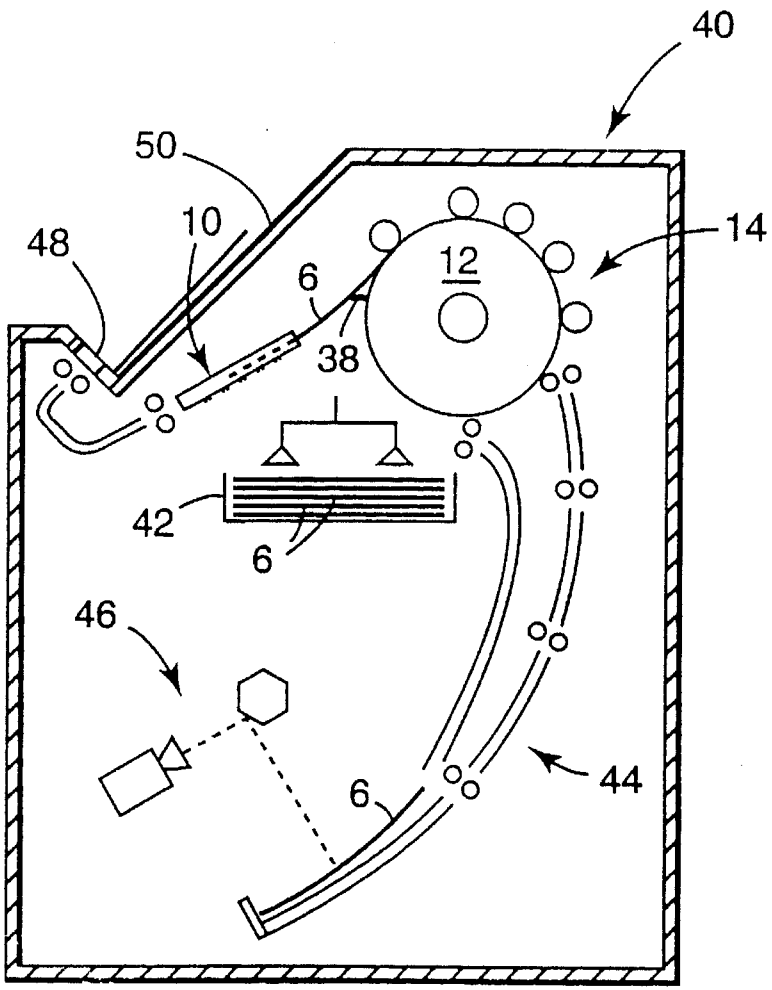
FIG. 3 is a side view of a photothermographic imager which includes the cooling article shown in FIG. 2.

The cooling article 10 and the other components of the thermal-processing apparatus 14 can be part of a larger apparatus, such as the photothermographic imager 40 shown in FIG. 3. The photothermographic imager 40 can include a container 42 for holding photothermographic sheets. Transport mechanisms 44 can transport the sheets 6 from the container 42 to an exposure station or apparatus 46 and to the thermal-processing apparatus 14. The exposure apparatus 46 scans a light beam onto the sheet 6 in an image-wise pattern to create a first or latent image in the sheet 6. The thermal-processing apparatus 14 heats the sheet 6 to a sufficient temperature for a sufficient duration to develop the latent image in the sheet 6 to a visible image. The cooling article 10, as noted, cools the sheet 6 before the sheet 6 is transported through an exit slot 48 to a holding surface 50.

Other embodiments of the cooling article 10 and other apparatuses and methods, similar to the previously noted embodiments, apparatuses, and methods, are contemplated by the inventors. One such embodiment, shown in FIGS. 4–6, can include a top surface 20A having a first cooling portion 52A and a second material. A more detailed description of the first cooling portion 52A, including the felt material or similar materials, is included in a co-pending United States patent application (filed on even date herewith by 3M Company and designated initially as 3M Docket No. 51868USA5A, and entitled Article for Cooling A Sheet of Thermally Processed Material). The disclosure within this co-pending patent application is hereby incorporated by reference.

The second cooling article or portion 54A can be perforated. With a perforated portion, photothermographic elements can be cooled quickly without significantly affecting optical density uniformity. This is particularly true for the first several photothermographic elements which are passed through the cooling apparatus 10A. Because the cooling apparatus can be at room temperature when the first several (heated) elements are cooled, the significant temperature differential between the elements and the cooling apparatus 10A can affect optical density uniformity. The perforations 56A allow the cooling apparatus 10A to be more quickly heated to a steady-state temperature. As a result, the cooling process is less detrimental, in terms of optical density uniformity, to the first cooled elements (e.g., the first 20 sheets).

The perforations 56A, like a textured top surface, can affect and provide control of the cooling rate of the sheet 6A. The perforations 56A, unlike the textured top surface, allow for air to pass through the second cooling article or portion 56A. This allows the bottom side of the sheet 6 and the second cooling article or portion 54A itself to be cooled convectively. The heated air resulting from the convection can be removed (and can be filtered) by an air exchange system within the overall apparatus. In addition to controlling the cooling rate of a sheet, perforations 56A allow for consistent cooling throughout each sheet and from sheet-to-sheet such that optical density uniformity is improved.

Figure 4:
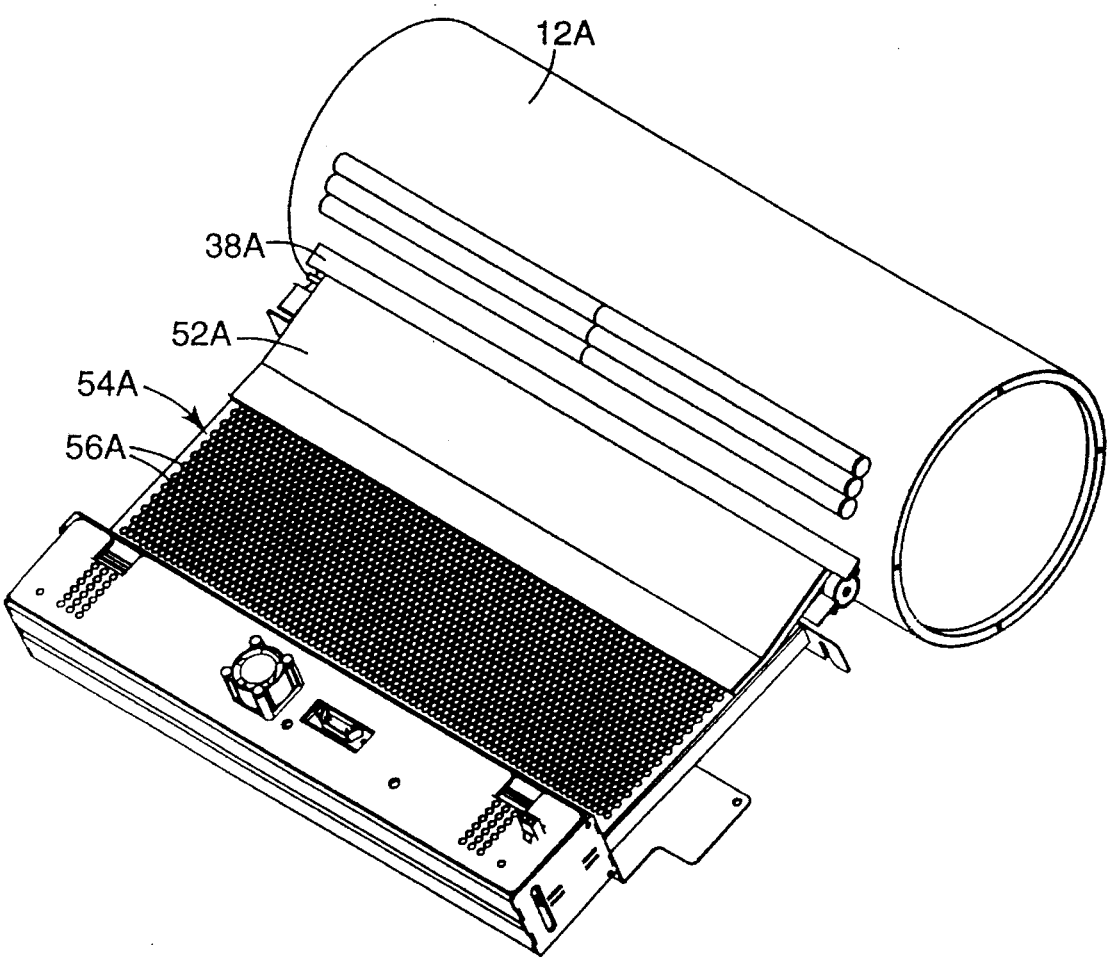
FIG. 4 is a perspective view of cooling system including another embodiment of the cooling article shown in FIGS. 2 and 3.
Figure 5:
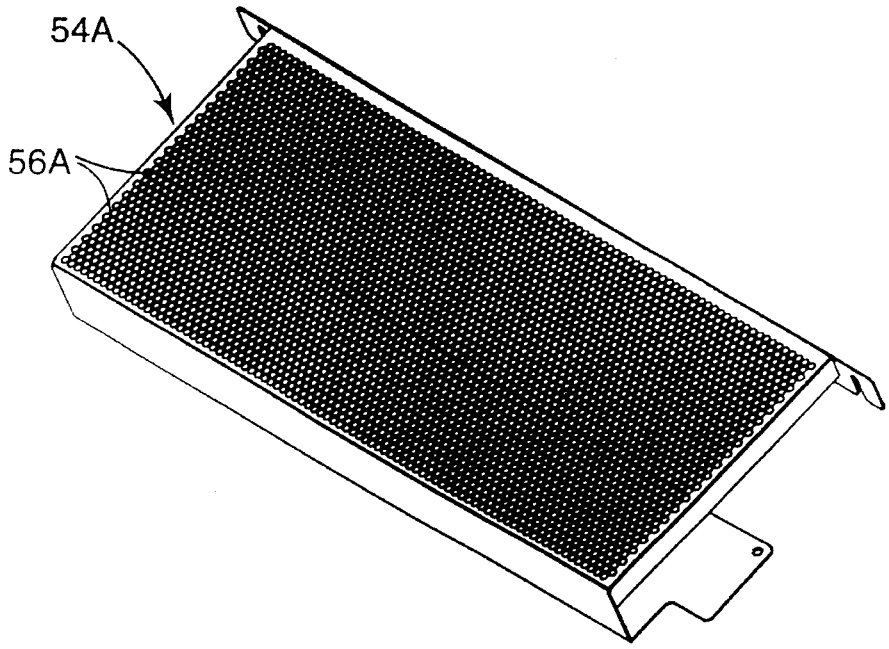
FIG. 5 is a perspective view of the perforated cooling article shown in FIG. 4.
Figure 6:
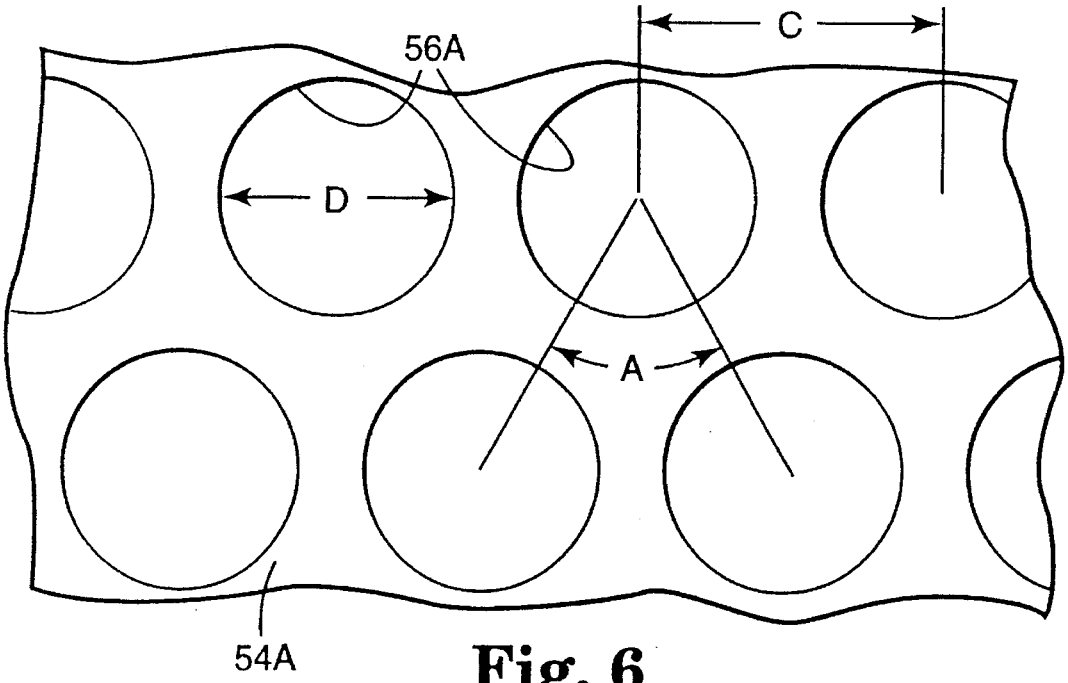
FIG. 6 is a partial top view of the cooling article shown in FIGS. 4 and 5.

The size and spacing of the perforations 56A can be particularly important factors. While an exact size and an exact spacing are not critical, FIGS. 4–6 illustrate one embodiment which is effective. The diameter D of the perforations 56A is approximately 3.97 millimeters with a tolerance of approximately +/–0.2 millimeters. The center-to-center distance C between adjacent perforations 56A is approximately 4.76 millimeters with a tolerance of approximately +/–0.2 millimeters. Across the second cooling portion 54A, the perforations 56A are aligned in rows (i.e., aligned rows in the cross-web direction). Down the length of the second cooling portion 54A (in the direction which the sheet travels or down-web direction), the perforations 56A are staggered. The stagger angle A is approximately 60 degrees, with a tolerance of approximately +/–one degree. With this size and spacing arrangement, approximately sixty-three percent (63%) of the second portion 54A is open due to the perforations 56A. Conversely, thirty-seven percent (37%) is not open and can contact the sheet 6.

The staggering of the perforations 56A is one way of assuring that all portions or all critical portions of the sheet 6 make contact with approximately the same amount of cooling material (in this embodiment, the cooling material is the Aluminum of the second cooling portion 54A). Other patterns for assuring this other than staggering are envisioned.

Other size and spacing arrangements could be used which provides approximately the same percentage. And, still other size and spacing arrangements could be used which provide an open percentage which ranges from 55 percent to 70 percent (conversely, 30 to 45 non-open percentage). Or, the open percentage could range from 50 to 75 percent. The finally determined percentage depends on optimizing the rate of cooling and the need to maintain a level of optical density uniformity. This optimization depends at least partially on the material which is being cooled (i.e., emulsion-type, material mass, etc.).

The second cooling portion 54A can be perforated in a number of ways. A key criterion is that the second cooling portion 54A of the top surface 50A be substantially (and preferably, completely) free of burrs and other significant surface roughness. This will minimize scratching, marring, or other damage to a sheet 6A when the sheet 6A slides over and is cooled by the second cooling portion 54A. One way of perforating the second cooling portion is by using a sharp-pointed, conical punch. The conical shape minimizes the creation of burrs on the top surface 50A when the punch is retracted from each perforation 56A. This also results in perforations 56A which slope away from the top surface 50A. Sloped perforations can be less likely to damage a sheet having a sufficiently soft material (photothermographic coating) which could be damaged by a flatter perforation (e.g., a drilled perforation).

The second cooling article or portion 56A can be made of a thermally conductive material such as aluminum, copper, steel, or the like. Aluminum is preferred due to its high thermal conductivity and its high heat capacity. An aluminum component reaches a steady state more quickly than a similar sized, shaped steel component.

What is claimed is:

1. A cooling article adapted for use with a thermal-processing apparatus for cooling a thermally-processable element after the element is heated by a heating member within the thermal-processing apparatus, wherein the cooling article comprises a cooling plate having a top surface, wherein the top surface is positioned relative to the heated member so that the element is transported from the heating member and slides on at least a portion of the top surface, and wherein the top surface is textured so that not more than 80 percent of the portion of the top surface on which the element slides contacts the element.

2. The cooling article of claim 1, wherein the top surface is textured so that between 20 and 80 percent of the portion of the top surface on which the element slides contacts the element.

3. The cooling article of claim 1, wherein the top surface is textured so that between 40 and 70 percent of the portion of the top surface on which the element slides contacts the element.

4. The cooling article of claim 1, wherein the top surface is textured so that between 50 and 65 percent of the portion of the top surface on which the element slides contacts the element.

5. The cooling article of claim 1, wherein the top surface is stationary.

6. The cooling article of claim 1, wherein the cooling plate has a bottom surface, and wherein the cooling article further comprising at least a first fin, wherein the first fin is thermally conductive and thermally coupled to the bottom surface of the cooling plate.

7. The cooling article of claim 6, wherein the cooling article further comprises an epoxy layer which couples the first fin to the bottom surface of the cooling plate.

8. The cooling article of claim 1, further comprising:

side walls connected to and extending approximately orthogonally from the cooling plate; and a top cover connected to the side walls forming a chute with the side walls and the cooling plate.

9. The cooling article of claim 8, wherein the cooling plate has side ends, and wherein the side walls are formed by bending the side ends upwardly.

10. The cooling article of claim 8, wherein the top cover comprises a main portion and two leg portions connected to the main portion, wherein the two leg portions and the main portion define an open portion in the top cover.

11. The cooling article of claim 1, wherein the portion of the cooling plate on which the element slides has a length of not more than 18 centimeters, wherein the element is a sheet having a surface area of not less than 1500 square centimeters, wherein the cooling article has sufficient thermal mass and conductivity to cool the element not less than 30 degrees Centigrade at rate of one element every 30 seconds.

12. The cooling article of claim 11, wherein the cooling article has sufficient thermal mass and conductivity to cool the element not less than 60 degrees Centigrade at a rate of one element every 30 seconds.

13. An apparatus for thermally processing a thermally-processable imaging element, comprising:

a housing;

a heating member within the housing which receives and heats the thermally processable imaging element; and a cooling article positioned relative to the heating member to receive the thermally-processable imaging element from the heating member and cool the thermally-processable imaging element, wherein the cooling article includes a cooling plate having a cooling surface positioned relative to the heating member so that the thermally-processable imaging element is transported from the heating member and slides on at least a portion of the cooling surface, wherein the cooling surface is perforated.

14. The apparatus of claim 13, further comprising an exposure station for exposing a first image onto thermally processable element which can be processed into a visible image by the heating member.

15. An apparatus for creating a visible image on a photothermographic element, comprising:

a housing having an input station, wherein the input station can accept a container containing the photothermographic element;

transport means positioned within the housing and relative to the input station for transporting the photothermographic element within the housing;

an exposure station positioned within the housing and relative to the transport means, wherein the exposure station can receive the photothermographic element from the transport means and expose the photothermographic element to an image-wise pattern of light to create a first image on the photothermographic element;

a thermal processing station positioned within the housing and relative to the transport means and the exposure station, wherein the thermal processing station includes a heating member which can receive the photothermographic element transported by the transport means from the exposure station and can heat the photothermographic element to a sufficient temperature for a sufficient duration to process the first image to the visible image;

directing means positioned relative to the heating member for directing the photothermographic element from the heating member; and a cooling article for cooling the photothermographic element, wherein the cooling article includes a cooling surface positioned relative to the directing means and the heating member so that the photothermographic element slides on at least a portion of the cooling surface, and wherein the cooling surface is perforated.

16. A method of minimizing curling of an exposed thermally-processable element while cooling the element after the element is heated by a heating member within the thermal-processing apparatus, comprising the step of directing the element across a cooling plate having a top surface positionable relative to the heated member so that the element is transported from the heating member and slides over at least a portion of the top surface, wherein the top surface is textured so that not more than 80 percent of the portion of top surface on which the element slides contacts the element.

17. The method of claim 16, wherein the top surface is textured so that between 20 and 80 percent of the portion of top surface on which the element slides contacts the element.

18. The method of claim 16, wherein the top surface is textured so that between 40 and 70 percent of the portion of top surface on which the element slides contacts the element.

19. The method of claim 16, wherein the top surface is textured so that between 50 and 65 percent of the portion of top surface on which the element slides contacts the element.

20. The method of claim 16, wherein the thermally-processable element has a polymeric film side and an emulsion coating side, wherein the directing step includes directing the emulsion coating side in contact with the top surface, and wherein the top surface is stationary.

21. A cooling article for cooling a thermally-processable imaging element after the element is heated by a heating member, wherein the cooling article comprises a cooling member having a cooling surface, wherein the cooling surface is positioned relative to the heated member so that the element is transported from the heating member and slides on at least a portion of the cooling surface, the cooling surface being perforated.

22. The cooling article of claim 21, the cooling surface being perforated such that between 50 and 75 percent of the cooling surface over which the element is transported is open.

23. The cooling article of claim 21, the cooling surface being perforated such that between 55 to 70 percent of the cooling surface over which the element is transported is open.

24. The cooling article of claim 21, the cooling surface being perforated such that 63 percent of the cooling surface over which the element is transported is open.

25. A method for cooling a thermally-processable imaging element after the element is heated by a heating member within a thermal-processing apparatus, comprising the step of directing the element across a cooling plate having a cooling surface positionable relative to the heated member so that the element is transported from the heating member and slides over at least a portion of the cooling surface, wherein the cooling surface is perforated.

* * * * *